US006919545B2

(12) United States Patent
Chen

(10) Patent No.: US 6,919,545 B2
(45) Date of Patent: Jul. 19, 2005

(54) DEVICE FOR ADVANCING EVEN DISTRIBUTION OF HIGH CYCLE WAVE MAGNETISM

(76) Inventor: Shia Chung Chen, 11Fl., No. 14, Lane 236, Sec. 1, Jhuangjing Rd., Taoyuan City, Taoyuan County (TW)

( * ) Notice: Subject to any disclaimer, the term of this patent is extended or adjusted under 35 U.S.C. 154(b) by 0 days.

(21) Appl. No.: 10/680,057

(22) Filed: Oct. 6, 2003

(65) Prior Publication Data

US 2005/0072775 A1 Apr. 7, 2005

(51) Int. Cl.[7] ..... H05B 6/64

(52) U.S. Cl. ..... 219/672; 219/634; 219/656

(58) Field of Search ..... 219/672, 656, 219/671, 675, 635, 619, 607, 609, 646, 643, 634, 632, 650; 148/567, 571, 646; 336/57, 183, 220; 399/330, 328, 331

(56) References Cited

U.S. PATENT DOCUMENTS

| | | | | |
|---|---|---|---|---|
| 2,182,820 A | * | 12/1939 | Pisarev | 219/634 |
| 2,604,419 A | * | 7/1952 | Hernenar | 148/567 |
| 6,555,801 B1 | * | 4/2003 | LeMieux et al. | 219/656 |
| 2004/0004071 A1 | * | 1/2004 | Ogasawara et al. | 219/619 |

* cited by examiner

*Primary Examiner*—Quang T. Van
(74) *Attorney, Agent, or Firm*—Charles E. Baxley

(57) ABSTRACT

The present invention of a device for advancing even distribution of high cycle wave magnetism uses a coil body having characteristics of conducting high cycle wave magnetism energy. The coil body is coiled in such a way that appears to have undulating distributed layers structure. A plurality of neighboring coil parts is annularly formed to become the coil body. Magnetism goes through any two neighboring coil parts will not repel or counteract each other because the neighboring coil parts are not on the same plane. Thus the present invention can advance high cycle wave magnetic field distributed more evenly.

4 Claims, 10 Drawing Sheets

Temperature distribution

Magnetism density

Temperature distribution

Magnetism density

Temperature distribution

Magnetism density

Temperature distribution

Infrared thermal image

DEVICE FOR ADVANCING EVEN DISTRIBUTION OF HIGH CYCLE WAVE MAGNETISM

BACKGROUND OF THE INVENTION

The present invention of a device for advancing even distribution of high cycle wave magnetism which can be widely applied in industrial purposes or household appliances. The conventional die-heating device as shown in FIG. 1, that we name it prior art 1. Prior art 1 uses preheating in an injection-forming die, that is an upper die and a lower die are pre-heating to a certain required temperature before the dies' are combined together, so that melted plastic inside can flow smoothly to a cavity inside the dies, then it will be cooled down for forming process. A heating element (91) is inserted between the upper and the lower die for pre-heating process. As shown in FIG. 2, the heating element (91) is a coil body coiled in spiral shape. Electricity is conducted through the heating element (91) by means of high cycle wave theory, thus heating effect is achieved by electromagnetic wave induction.

The drawbacks of such device are, the heating element (91) is formed when it is being coiled, and many coil parts are annularly arranged and in neighboring to each other. When electromagnetic wave passes through the heating element (91), any two neighboring coils will repel or counteract each other because the neighboring coils have the same pole, this will cause the high cycle wave magnetism distributed unevenly and lead to ineffective heating performance. Therefore how the dies are being formed and heated is critical in this field. Household appliances using electromagnetic wave has its disadvantage. As shown in FIGS. 3 and 4, which has publication number 335247, named "Inductive Heating Coil for Rice Cooker", which we will call it prior art 2. Prior art 2 uses an inductive heating coil (92) in spiral shape, with distances between the annular coils on the peripheral of the inductive heating coil (92) shorter those on the inner annular coils near the center. Again, any two neighboring coils will repel or counteract each other because the neighboring coils have the same pole and are also on the same plane, this will cause the high cycle wave magnetism distributed unevenly and lead to ineffective heating performance. To tackle the drawbacks of the conventional devices, the present invention can advance even distribution of high cycle wave magnetism.

SUMMARY OF THE PRESENT INVENTION

The present invention of a device for advancing even distribution of high cycle wave magnetism uses an inductive heating coil body having characteristics of conducting high cycle wave magnetism energy. The coil body is coiled in spiral shape and in such a way that each coil part is arranged in different plane, so that the coil body has undulating layers structure. Magnetism goes through any two neighboring coil parts will not repel or counteract each other because the neighboring coil parts are not on the same plane. Thus the present invention can advance high cycle wave magnetic field distributed more evenly.

The present invention will become more fully understood by reference to the following detailed description thereof when read in conjunction with the attached drawings.

DETAILED DESCRIPTION OF THE PREFERRED EMBODIMENT

Figure 1:
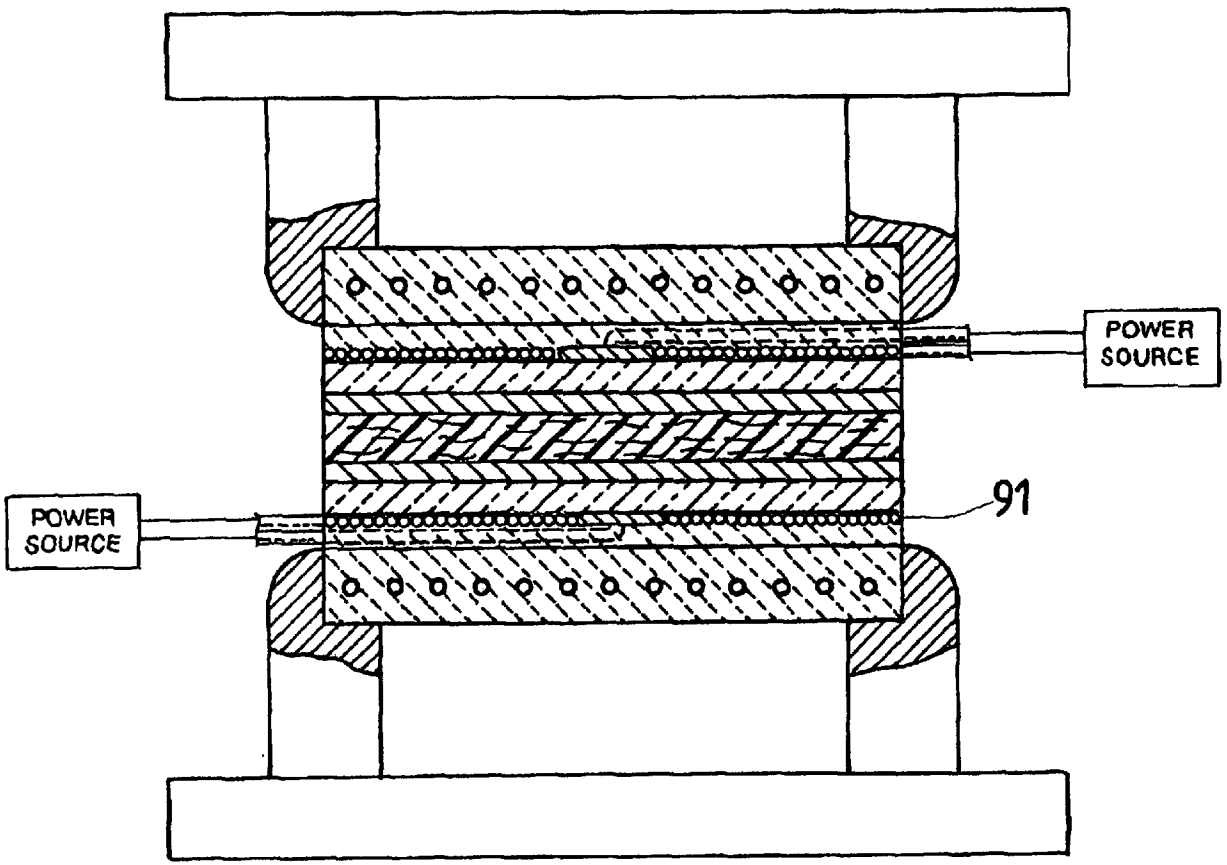
FIG. 1 PRIOR ART
FIG. 1 is a sectional view of an invention with U.S. Pat. No. 5,483,043 as a prior art.
Figure 2:
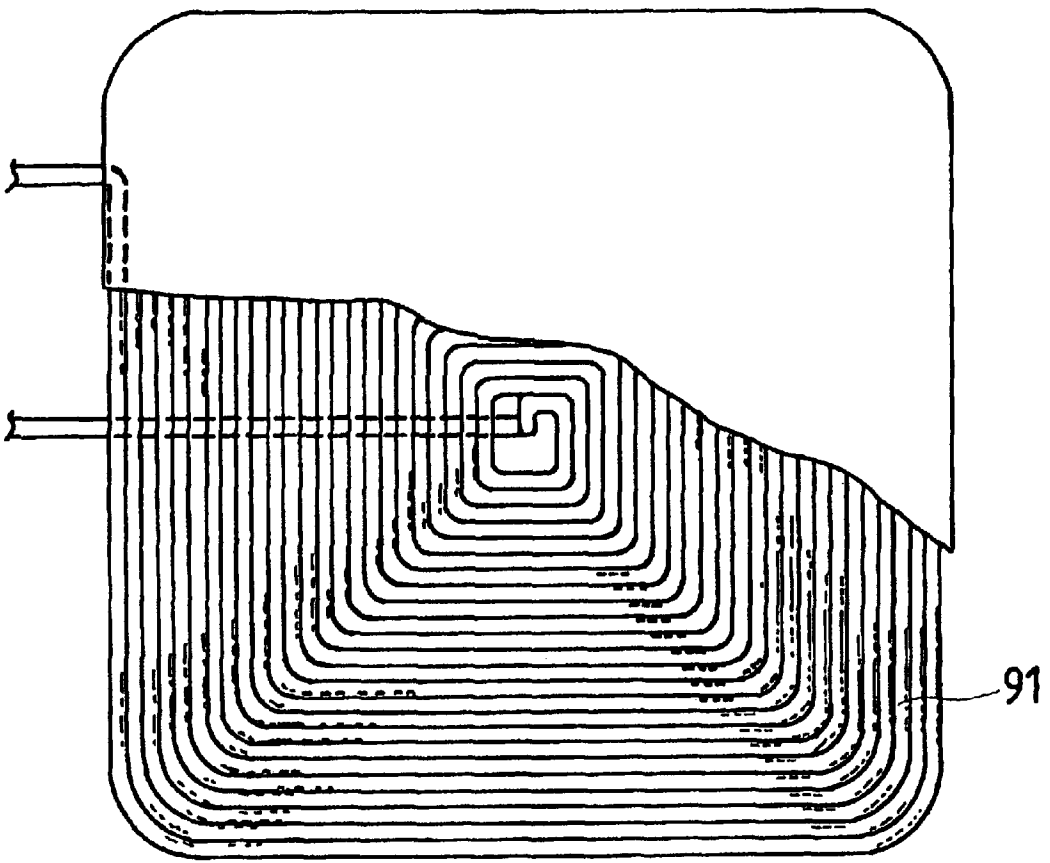
FIG.2 PRIOR ART
FIG. 2 is perspective view of FIG. 1 as a heating device.
Figure 3:
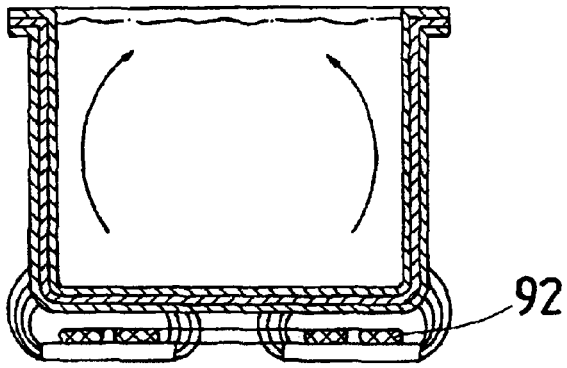
FIG.3 PRIOR ART
FIG. 3 is a sectional view of "Inductive Heating Coil for Rice Cooker" with Publication No. 335247.
Figure 4:
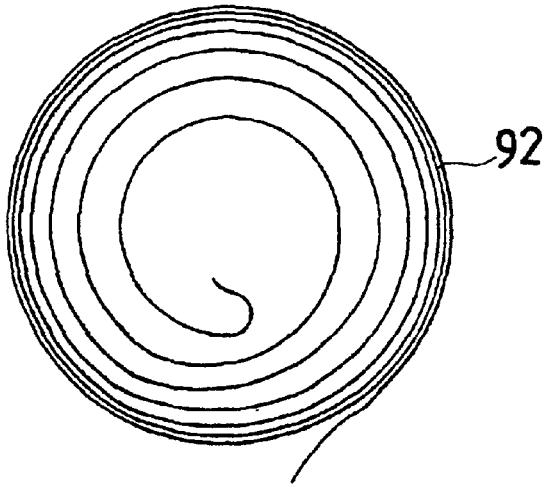
FIG.4 PRIOR ART
FIG. 4 is a perspective view of FIG. 3.

Referring to FIGS. 5–8, the present invention of a device for advancing even distribution of high cycle wave magnetism mainly comprises a inductive heating coil (10), the inductive heating coil (10) having many coil parts (11) formed from the center to the peripheral of the coil (10). All the coil parts (11) are not on the same plane to avoid any two neighboring coil parts (11) to repel or counteract each other, in order to advance high cycle wave magnetic field distributed more evenly.

The inductive heating coil (10) is in spiral shape and can induct high cycle wave magnetism, it is formed by a plurality of coil parts (11) annularly in neighboring to each other. The coil parts (11) are on different layers individually so that each coil part (11) is on a different plane. Therefore, the inductive heating coil (10) is conically formed and having one arching center with a plurality of coil parts (11) on different planes.

Besides the inductive heating coil (10), the present invention also comprises an object (2) for being heated. The object (2) can be an injection forming die for industrial use, or an appliance for household use. The present invention of a device for advancing even distribution of high cycle wave magnetism uses an injection-forming die (30) and a cooker (40) for cooking rice as three embodiments as described below.

Figure 5:
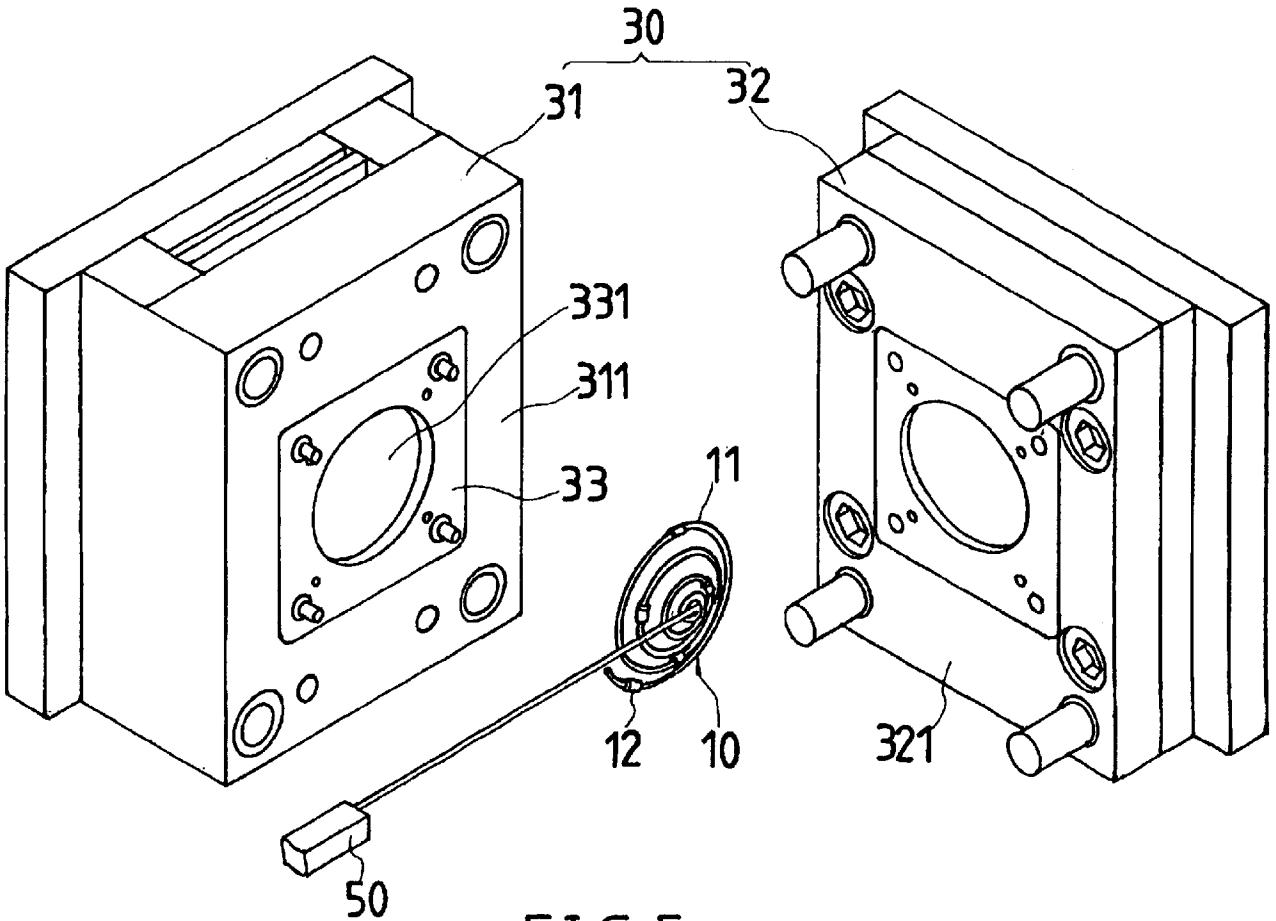
FIG. 5 is a perspective exploded view of a first embodiment of the present invention.

Referring to FIG. 5, the die (30) having a first die (31) and a second die (32). The dies (31) and (32) having die surface (311) and (321) respectively, a die contact part (33) is disposed on each die surfaces (311) and (321). The die contact part (33) having a die hole (331) for forming purpose. The inductive heating coil (10) is inserted between the die surface (311) of the first die (31) and the die surface (321) of the second die (32) by a mechanical arm (50). In order to avoid the inductive heating coil (10) in contact with the die (30) to induct electricity, the coil part (11) on the peripheral circle of the inductive heating coil (10) having a ceramic ring (12) for insulation.

Figure 6:
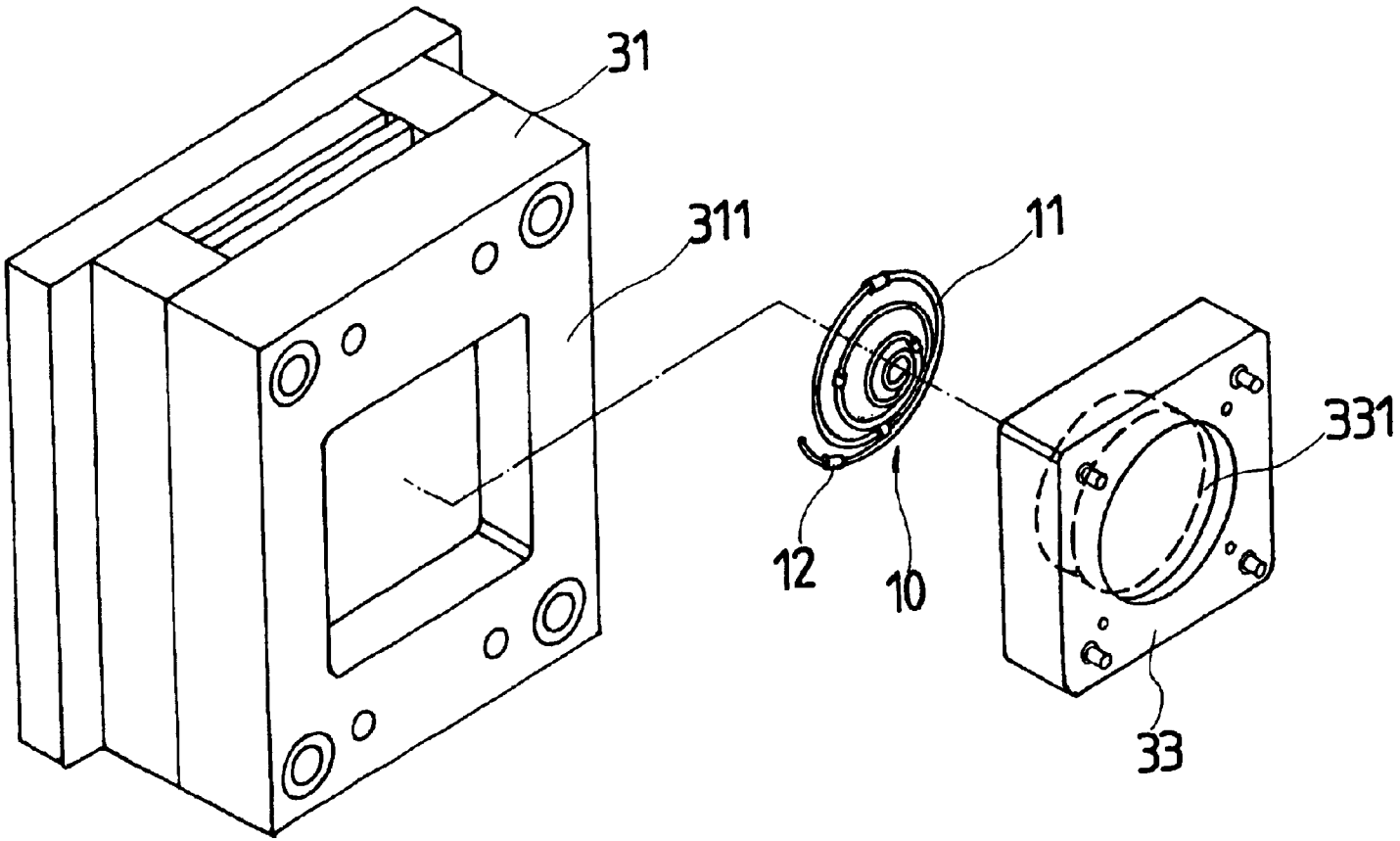
FIG. 6 is a perspective exploded view of a second embodiment of the present invention.
Figure 7:
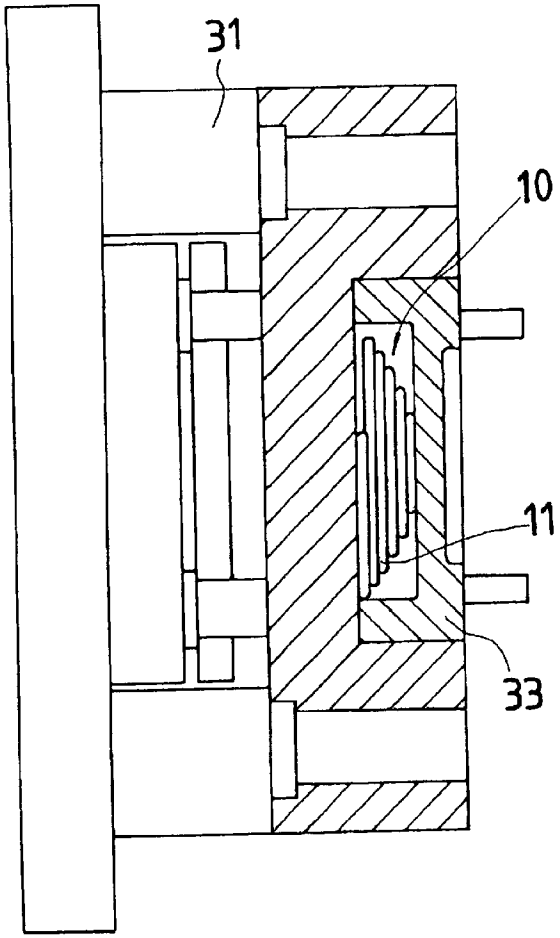
FIG. 7 is a sectional view of the second embodiment of the present invention.

As referring to FIGS. 6 and 7, before the inductive heating coil (10) is inserted flatly between the dies (31) and (32), an insulated layer (13) is coated on the peripheral coil part (11) to avoid electromagnetic wave from the inductive heating coil (10) in contact with the die (30) to induct electricity.

Figure 8:
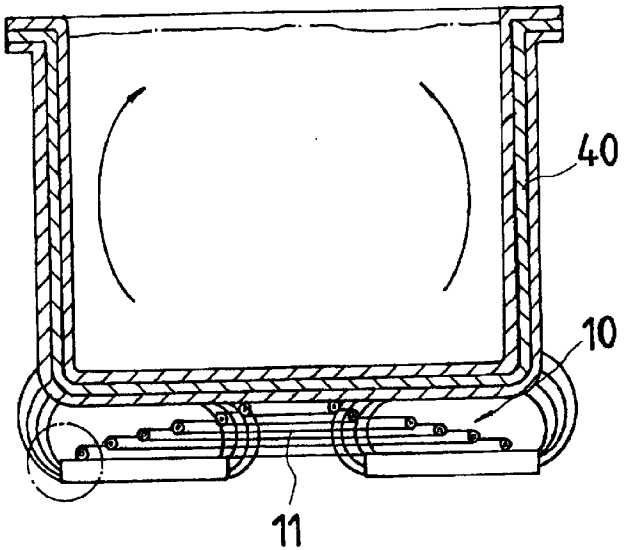
FIG. 8 is a sectional view of a third embodiment of the present invention.
Figure 8A:
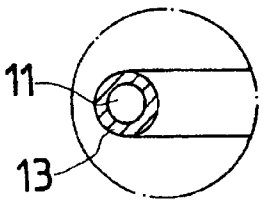
FIG. 8A is an enlargement view of a coil part with an insulated layer coated on it.

Referring to FIG. 8, when the inductive heating coil (10) is applied in the cooker (40) or any other electric appliances that required heating, the coil (10) is coated with the insulated layer (13) to avoid induction of electricity, and is disposed near the bottom edge of the cooker (40).

According to the three embodiments described above, the object (2) is heated by the inductive heating coil (10). The coil parts (11) are structured in such a way that each coil part (11) is on a different plane, in order to avoid any two neighboring coil parts (11) to repel or counteract each other, so as to advance high cycle wave magnetic field distributed more evenly.

Referring FIGS. 9 to 12, which are computerized demonstrations show heating areas achieved by changing the way in which the inductive heating coil (10) is coiled as described in the present invention. The distribution of temperature and magnetism is more evenly and having better heating effect than the conventional coil. Same parameter is used in FIG. 9 for the prior art and in FIGS. 10 to 12 for the present invention.

Figure 9:
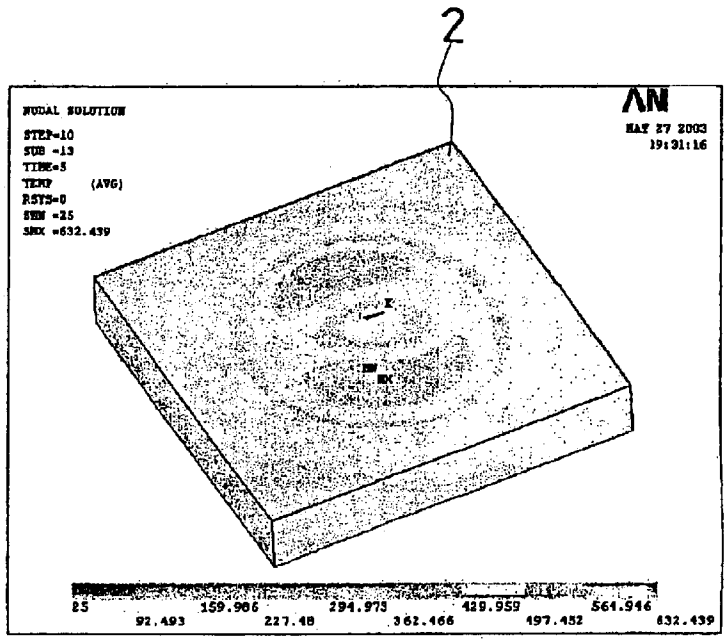
FIG.9 PRIOR ART
FIG. 9 shows the distribution of temperature and magnetism of the prior art of an inductive heating coil.
Figure 9:
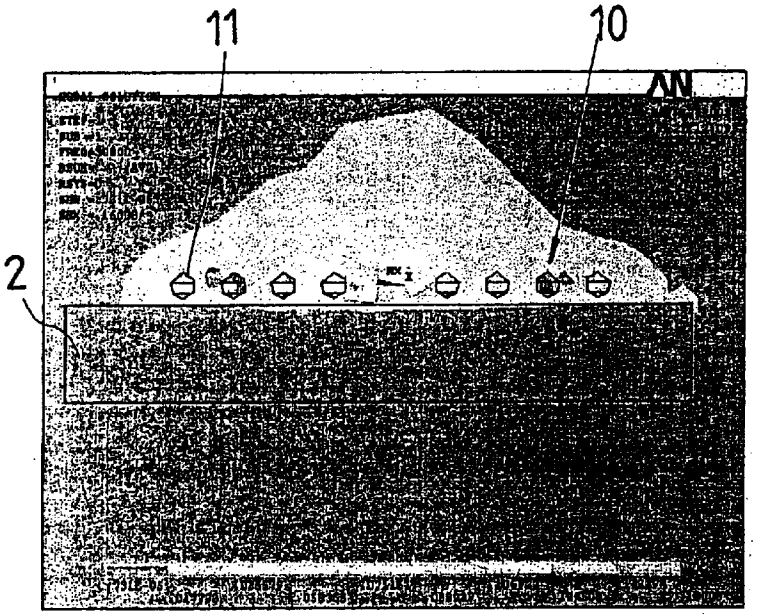
FIG.9 PRIOR ART

Referring to FIG. 9, the conventional prior art type inductive heating coil having coil parts on the same plane. The colors indications below each figure indicate different values for different colors representing temperature and magnetism values. Thus distribution of temperature and density of magnetism are shown clearly to indicate its heating effectiveness. As for the temperature distribution, the red area of the highest heating temperature is relatively small and discontinuously broken into two semi circle areas. It shows that the heating areas are distributed unevenly for ineffective heating result.

Figure 10:
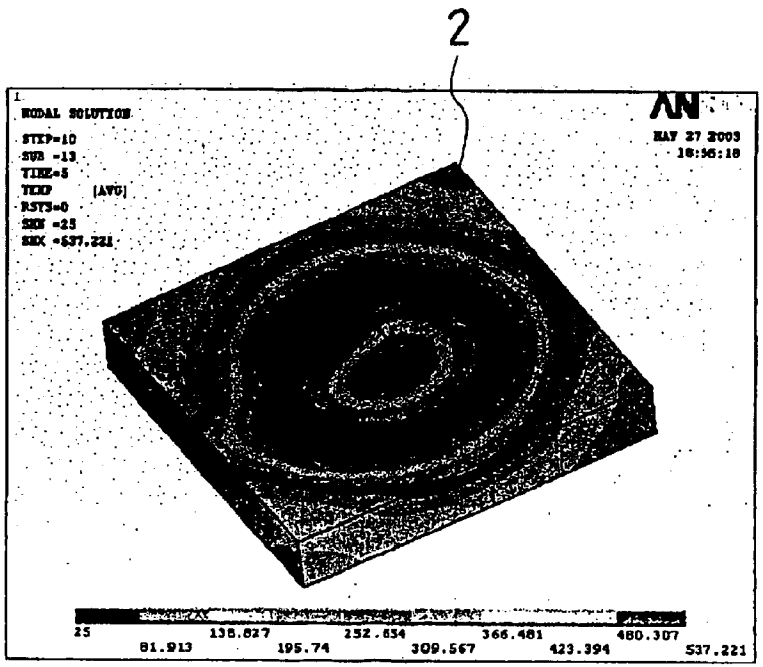
FIG. 10 a first demonstration of the distribution of temperature and magnetism of the present invention.
Figure 10:
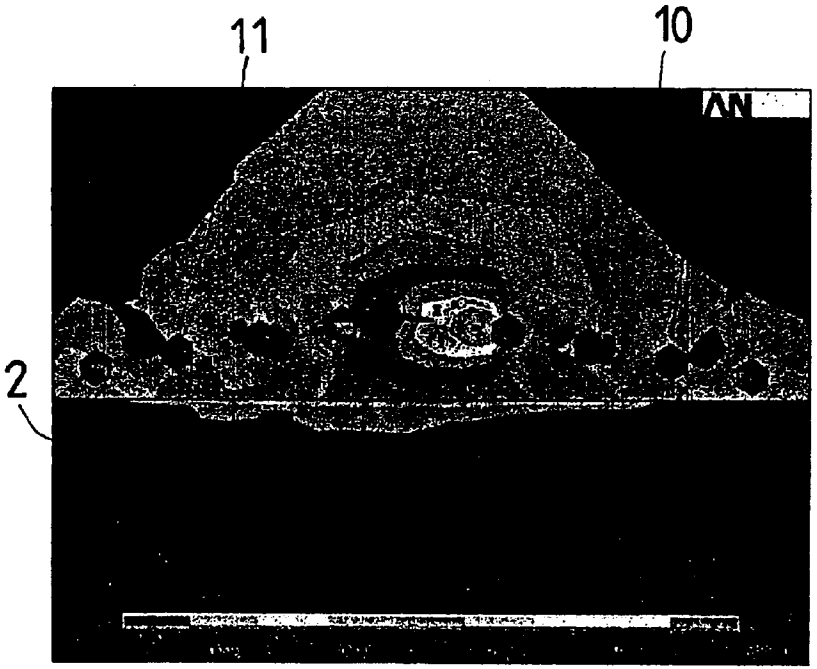
Figure 11:
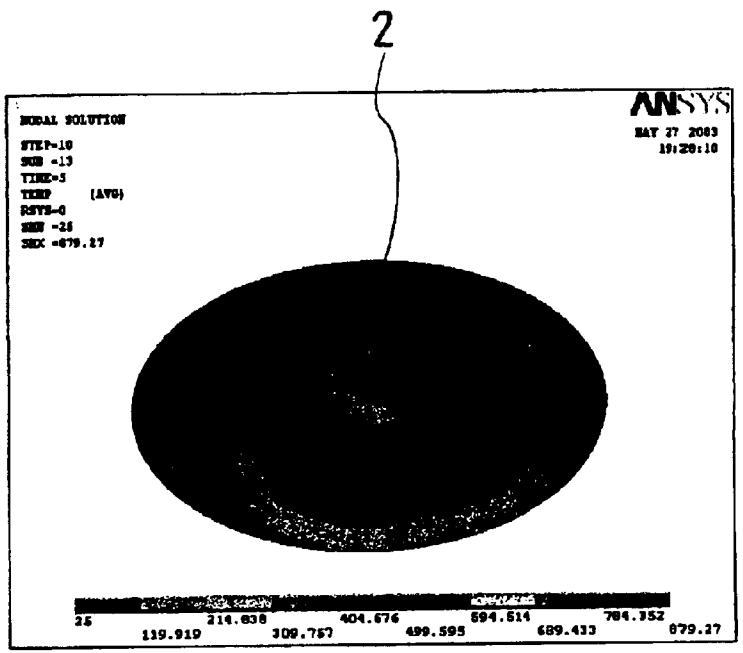
FIG. 11 a second demonstration of the distribution of temperature and magnetism of the present invention.
Figure 11:
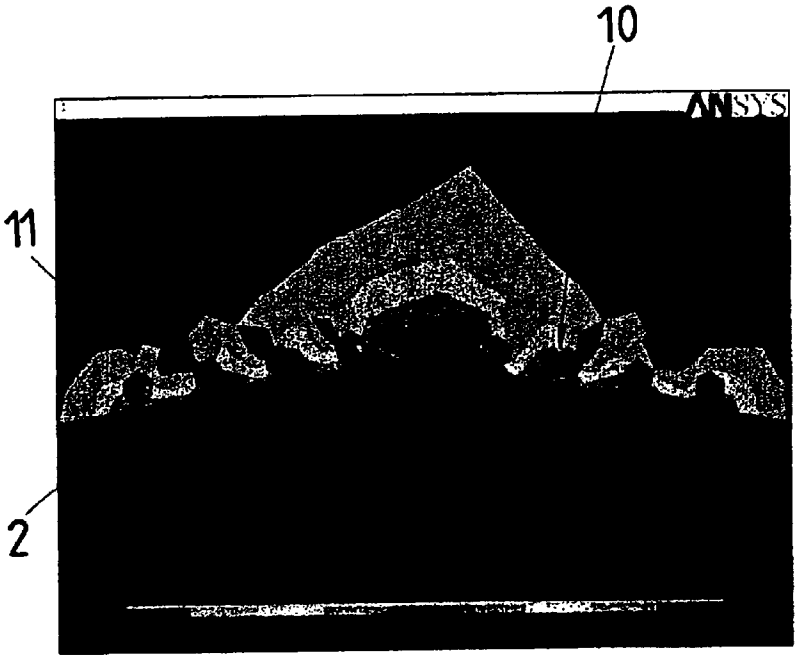

Referring to FIGS. 10 and 11, show the inductive heating coil (10) of the present invention applied in the object (2) of flat and conical shapes. The red area for indicating the highest temperature is distributed widely and is in complete annular shape. The green area indicating the medium temperature is more widely distributed than it shows in FIG. 9. Besides, the overall temperature is also distributed more evenly than the prior art, which is even more clearly demonstrated in FIG. 11 applied in the object (2) of conical shape.

When the inductive heating coil (10) is inserted inside or near the edge of the die (30) or the cooker (40) respectively for heating, the coil (10) can has its arching or its concave side facing the surface of the object (2) that required heating. The FIGS. 10 and 11 only show the inductive heating coil (10) having its concave side facing the object (2). The inventor of the present invention has experimented that the most effective heating performance is achieved by having the coil (10) disposed with the arching side facing the object (2), which will be fully understood by reference to FIG. 12.

Figure 12:
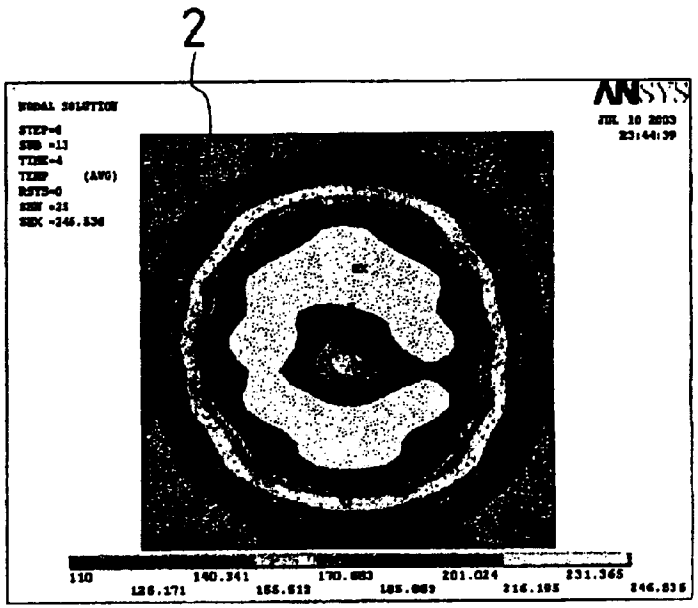
FIG. 12 a third demonstration of the distribution of temperature and magnetism of the present invention.
Figure 12:
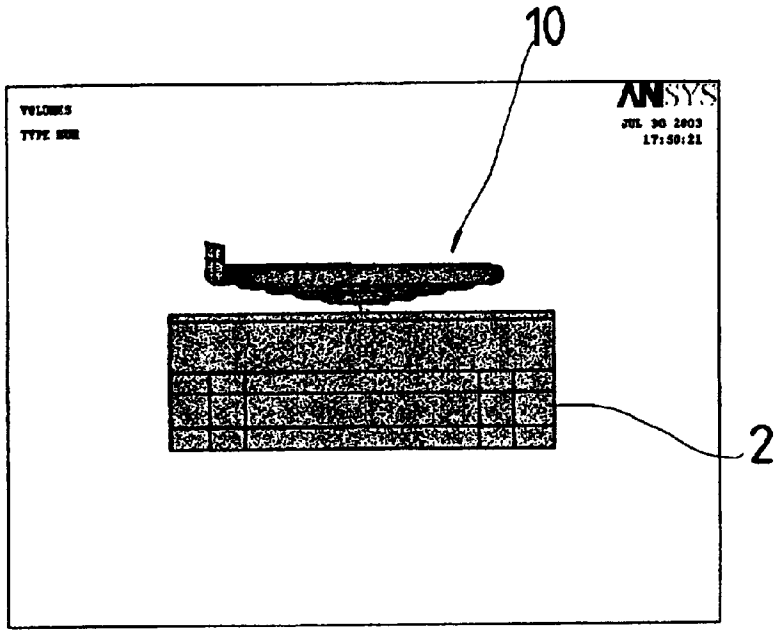

Referring to FIG. 12, the inductive heating coil (10) having its arching side facing the object (2). According to this disposition, even though the coil part (11) of the inductive heating coil (10) having a lower heat energy, the coil part (11) at the center can still induct more effective heating energy because it is near the surface of the object (2).

The heating temperature of the red area in the middle is closed to the highest temperature in the white area. The green area on the outer part shows that it can also reach a high temperature value for the best heating performance.

I claim:

1. A device for advancing even distribution of high cycle wave magnetism comprising:

an object for being heated, an inductive heating coil applied to induct electromagnetic wave on said object, in order to heat said object, said inductive heating coil being a coil body in spiral shape for induct high cycle wave magnetic energy, and including a plurality of coil parts in neighboring to each other and arranged on different planes, in order to avoid any two said neighboring coil parts to repel or counteract each other, so as to advance high cycle wave magnetic field distributed more evenly, said inductive heating coil being moved independently and disposed near a peripheral edge of said object for heating, and including one end fixed and held by a mechanical arm for moving and disposed at a proper place, said coil parts including a plurality of ceramic rings for insulation, in order to avoid said inductive heating coil in contact with said object.

2. The device for advancing even distribution of high cycle wave magnetism as claimed in claim 1, said inductive heating coil is coiled as a shape of non-flat structure.

3. The device for advancing even distribution of high cycle wave magnetism as claimed in claimed 1, said inductive heating coil is inserted inside said object, its peripheral coil part is coated with an insulated layer, in order to avoid electromagnetic wave of said inductive heating coil in contact with said object.

4. The device for advancing even distribution of high cycle wave magnetism as claimed in claim 1, said object is a die which required high cycle wave for heating purposes.

* * * * *